United States Patent [19]

Wilkes

[11] 4,121,491

[45] Oct. 24, 1978

[54] SOLENOID MOUNTING PLATE FOR MUSICAL KEYBOARD

[75] Inventor: Thomas Jewel Wilkes, Lewisburg, Tenn.

[73] Assignee: Teledyne Industries, Inc., Los Angeles, Calif.

[21] Appl. No.: 809,732

[22] Filed: Jun. 24, 1977

Related U.S. Application Data

[63] Continuation-in-part of Ser. No. 681,095, Apr. 28, 1976, Pat. No. 4,031,797.

[51] Int. Cl.[2] ..... G10F 5/02

[52] U.S. Cl. ..... 84/20; 211/26

[58] Field of Search ..... 84/16–23, 84/107, 111–113, 244–246, 251; 335/255; 211/26

[56] References Cited

U.S. PATENT DOCUMENTS

| | | | |
|---|---|---|---|
| 906,373 | 12/1908 | Billings | 84/251 |
| 1,138,103 | 5/1915 | Hauss et al. | 84/20 |
| 3,126,783 | 3/1964 | Von Gunten | 84/246 |
| 3,581,254 | 5/1971 | Cannon et al. | 84/107 X |
| 4,031,796 | 6/1977 | Wilkes | 84/20 |

FOREIGN PATENT DOCUMENTS

| | | | |
|---|---|---|---|
| 893,783 | 2/1972 | Canada | 84/19 |
| 156,950 | 1/1921 | United Kingdom | 84/251 |

*Primary Examiner*—Lawrence R. Franklin
*Attorney, Agent, or Firm*—Jim Zegeer

[57] ABSTRACT

There is disclosed an improved mounting plate or rack for mounting a large number of solenoids in a keyboard-actuated musical instrument. The mounting rack is an extruded plate having locking slots formed in the surface thereof and a pair of cooperating actuator alignment ribs on the edges of the planar surfaces of the rack, respectively, one rib for aligning every other actuator and the other rib on the opposite side of the plate for aligning the remaining of the actuators.

2 Claims, 2 Drawing Figures

SOLENOID MOUNTING PLATE FOR MUSICAL KEYBOARD

REFERENCE TO RELATED APPLICATION

This application is a continuation-in-part of application Ser. No. 681,095, filed Apr. 28, 1976 for "Solenoid Mounting Assembly for Musical Keyboard", now U.S. Pat. No. 4,031,797.

BACKGROUND OF THE INVENTION

In my above-identified related application, I disclose an extruded mounting plate or rack which has locking slots formed in the surface thereof and a cooperating groove formed in a longitudinally extending protrusion or rib in the center of the plate. This protrusion or rib serves as a guide for accurately positioning the frames or mounting brackets of each individual keyboard-actuating implements, such as a solenoid, and the mounting brackets have a pair of laterally extending flanges which are frictionally received in the grooves formed in the central rib. One of the off-set flanges causes spring pressure to be applied to the solenoid which permitted a single screw securement of the solenoid frame to the mounting plate or bar. The present invention eliminates the central rib and grooves and the spring locking tongue but retains the accurate and relatively wide freedom of adjustment of the solenoid frames in a common assembly. According to the present invention, the mounting rack has a longitudinal planar surface, and three screw slots which extend longitudinally along the length of the plate. Two longitudinal actuator alignment ribs are formed integrally on the edges of the planar surface, respectively, one alignment rib being used for aligning every other actuator and the other alignment rib being used for aligning the remaining of the actuators (the alternate ones). In order to achieve a closer packing density with this arrangement, the alternate corners of the actuator mounting brackets which are secured over the center of the locking screws have a cut-out portion so as to permit the frame to be secured by screw fasteners at this central portion of the plate.

BRIEF DESCRIPTION OF THE DRAWINGS

The above and other objects, advantages and features of the invention will become more apparent from the following specification taken in conjunction with the accompanying drawings wherein.

My above-identified application discloses a typical action assembly of a piano keyboard and the relationship of the solenoid actuators to the keys.

Figure 2:
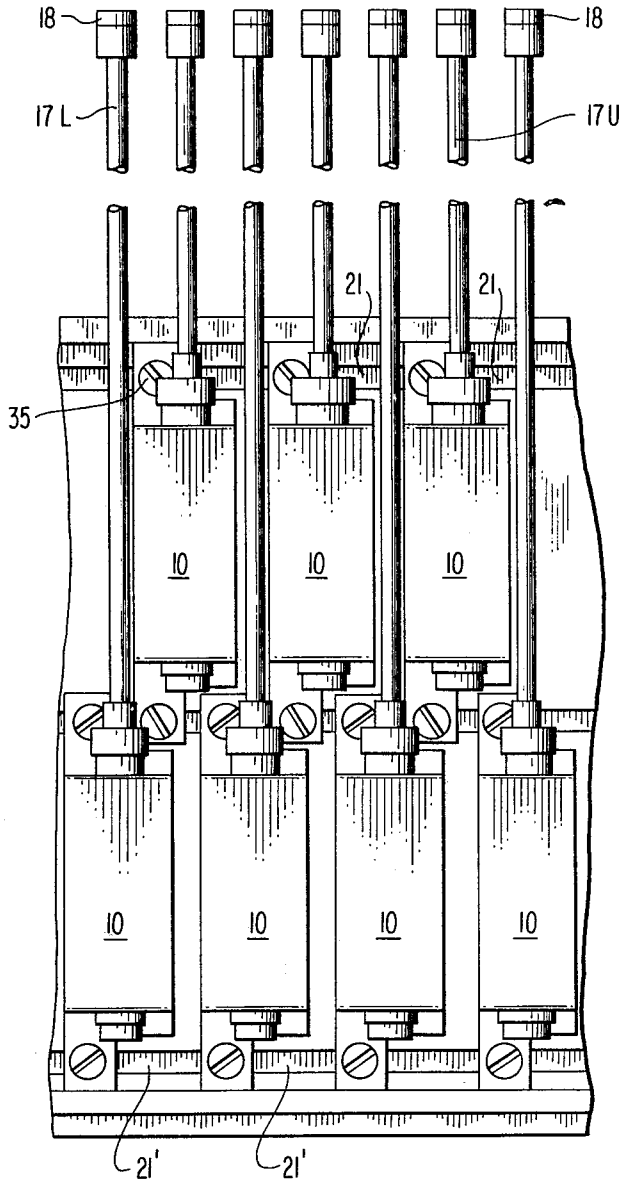
FIG. 2 is a top plan view thereof.
Figure 1:
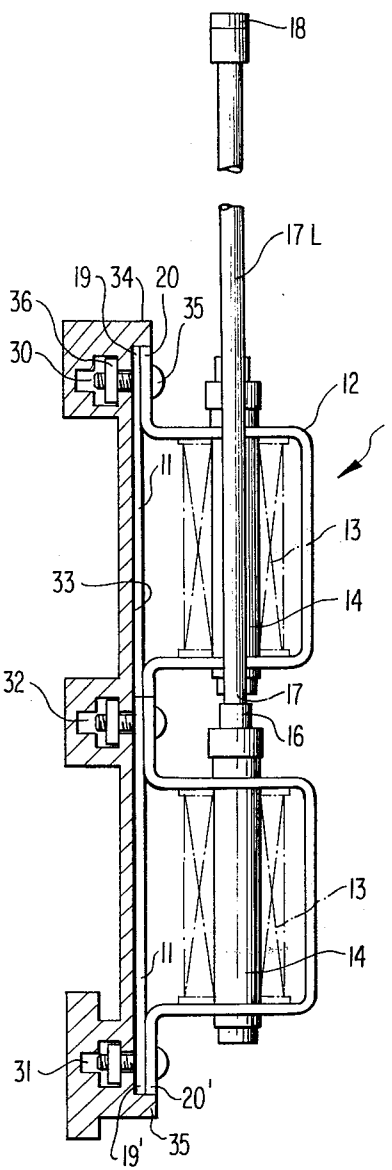
FIG. 1 is a cross-sectional view of a mounting rack or plate incorporating the invention.

FIGS. 1 and 2, taken collectively, illustrate a plurality of solenoid actuators 10, each of which has a mounting bracket or frame constituted by a back plate 11 and a U-shaped main frame member 12. The solenoid proper has an operating coil 13, a low friction bushing 14 and an armature (not shown) connected through a stop member 16 to a long arm or plunger 17. The assembly is adapted to be mounted beneath the keyboard of a piano so that the lower solenoid assembly arms 17L are longer than the upper solenoid arms or plungers 17U. The strike tips 18 of each arm or plunger are in accurate alignment since the stroke of each solenoid is the same so as to assure the same strike force for the piano keyboard.

Each of the back plate 11 and U-shaped member 12 have laterally extending gauge elements 19 and 20, respectively (the lower ones in FIG. 1 have been primed), and the alignment guide members 19 and 20 are secured together and have a screw hole therein. The opposite ends of the solenoids are identically formed. As best seen in FIG. 2 on the lower solenoid bracket elements and on the upper solenoid bracket elements, there is a cut-out portion designated by the numerals 21 and 21'. As shown where the ends of the upper and lower solenoid mounting brackets meet, the cut-out portions permit a closer packing of the solenoid mounting brackets without impeding the mounting of same. At the same time, it will be noted that the plungers and actuating arms may be made slightly shorter in length than in my previous invention and still achieve the same packing density (of course, the solenoids have to be aligned with the keys of the keyboard in any case but the present assembly is more compact and more flexible in that the solenoids may be aligned by virtue of each end having a separate screw fastener instead of just one end and the frictional engagement disclosed in my earlier application).

An extruded metal mounting bar member or rack 20 has a pair of lateral or upper and lower locking nut slots 30 and 31, respectively, which extend longitudinally along the plate. A central locking nut slot 32 is provided so that the surface 33 of the plate is planar. A pair of longitudinal actuator alignment ribs 34 and 35 is integrally extruded on the plate and serve as alignment ribs which are engaged by guide members or flanges 19, 20 to assure that the strike tips 18 are accurately aligned with one another. Separate screw fasteners 35 and nuts 36 in the grooves hold the mounting bracket in its proper position. The off-set position of the lateral flanges 19, 20 with respect to the solenoid per se, permits easy access by screwdriver or the like to these fastener members.

The disclosure of my above-identified application is incorporated herein by reference.

It will now be seen how the invention accomplishes its objects and achieves its various advantages. While the invention has been described and illustrated herein by reference to a preferred embodiment thereof, it is to be understood that various changes and modifications may be made in the invention by those skilled in the art without departing from the inventive concept, the scope of which is to be determined by the appended claims.

I claim:

1. In an extruded metal key solenoid actuator mounting rack for the piano keyboard wherein a plurality of key solenoid actuators are aligned in at least two parallel rows for operative actuation of the keys of the piano keyboard upon selective energization thereof, and each said key solenoid actuator is carried by said mounting rack, said mounting rack having a longitudinal planar surface and a plurality of longitudinal parallel locking nut slots proximate the edges of said mounting rack for receiving locking nuts for threaded fastener members, the improvement which comprises, a pair of longitudinal actuator alignment ribs integrally formed with said planar surface and defining the boundaries thereof, respectively, one rib for commonly aligning every other actuator, and one rib for commonly aligning the remaining alternate ones of said actuators, each said rib being adjacent one of said longitudinal parallel locking nut slots, a central longitudinal locking nut slot in said planar surface parallel to said pair of longitudinal actuator ribs and said plurality of longitudinal parallel locking nut slots proximate the edges of said mounting rack, each said longitudinal parallel locking nut slot receiving a locking nut in each slot for each actuator, respectively, and at least a pair of threaded fastener means, one at each end of an actuator, cooperating with locking nuts in each slot adapted to secure said key actuators flush against said planar locking surface and in abuttment with their respective alignment ribs without distorting the mounting frame for any of said actuators.

2. The invention defined in claim 1 wherein the mounting frame of each said key solenoid actuator includes a back plate member which is adapted to be mounted flush against said planar surface, and a U-shaped member, each of which has a cut-out portion for interfitting relationship with an adjacent alternate actuator.

* * * * *